US005232109A

United States Patent [19]

Tirrell et al.

[11] Patent Number: 5,232,109

[45] Date of Patent: Aug. 3, 1993

[54] DOUBLE-SEAL STOPPER FOR PARENTERAL BOTTLE

[75] Inventors: Joseph V. Tirrell, Sand Lake; Neil H. Brown, Nassau, both of N.Y.

[73] Assignee: Sterling Winthrop Inc., New York, N.Y.

[21] Appl. No.: 892,085

[22] Filed: Jun. 2, 1992

[51] Int. Cl.[5] ..... B65D 39/00

[52] U.S. Cl. ..... 215/247; 215/355; 215/DIG. 3; 604/411; 604/415

[58] Field of Search ..... 215/247, 249, 270, 274, 215/320, 355, DIG. 3; 604/411, 415

[56] References Cited

U.S. PATENT DOCUMENTS

| | | | |
|---|---|---|---|
| 2,665,024 | 1/1954 | Putz . | |
| 2,848,130 | 8/1958 | Jesnig . | |
| 3,088,615 | 5/1963 | Mumford et al. . | |
| 3,106,206 | 10/1963 | Barr, Sr. et al. | 215/247 X |
| 3,313,439 | 4/1967 | Robinson . | |
| 3,343,699 | 9/1967 | Nicko | 215/247 |
| 3,974,930 | 8/1976 | Gizard et al. . | |
| 4,133,441 | 1/1979 | Mittleman et al. . | |
| 4,134,512 | 1/1979 | Nugent | 215/247 |
| 4,193,402 | 3/1980 | Rumpler | 215/247 X |
| 4,226,334 | 10/1980 | Weiler et al. | 215/355 |
| 4,227,617 | 10/1980 | Albrecht et al. . | |
| 4,441,621 | 4/1984 | Matukura et al. . | |
| 4,515,752 | 5/1985 | Miramanda | 215/355 X |
| 4,664,275 | 5/1987 | Kasai et al. | 215/247 |
| 4,872,572 | 10/1989 | Schrooten | 215/307 |
| 4,923,072 | 5/1990 | Rilliet | 215/247 |
| 5,064,083 | 11/1991 | Alexander et al. | 215/247 |
| 5,125,921 | 6/1992 | Duschek | 215/247 X |

*Primary Examiner*—Allan N. Shoap
*Assistant Examiner*—Vanessa Caretto
*Attorney, Agent, or Firm*—Imre (Jim) Balogh; Arthur Rosenstein

[57] ABSTRACT

An elastomeric stopper for a fluid-containing bottle to hermetically seal the content therein and to provide access thereto by the insertion of an infusion device through the stopper, the stopper comprising an annular protuberance which forms a second seal with the shaft of the infusion device to prevent leakage, blow-out and introduction of particulate matter into the bottle.

1 Claim, 4 Drawing Sheets

DOUBLE-SEAL STOPPER FOR PARENTERAL BOTTLE

BACKGROUND OF THE INVENTION

1. Field of the Invention

This invention relates to an elastomeric stopper used in conjunction with bottles and vials containing pharmaceutical products for parenteral administration. More particularly, the invention relates to an elastomeric stopper for hermetically sealing a parenteral bottle or vial which is accessed by the use of an infusion spike.

2. Reported Developments

Stopper systems for vials, bottles and the like are made of materials that are resistant to chemicals and pharmaceuticals such as corrosive materials, reagents, parenteral solutions and solid formulations reconstitutable with a solvent prior to use. The most commonly used stopper system for such products has been glass or plastic bottles and vials equipped with rubber stoppers made of elastomeric materials. The system appears to provide for good hermetical seal, safe storage and easy access to the content through the elastomeric stopper via the use of an infusion spike when withdrawal of the content is desired. The elastomeric stopper used generally comprises an elastomeric base, such as natural or synthetic rubber and an inert coating covering at least some portions of the stopper. The coating used includes chlorobutyl rubber, polymeric fluorocarbon resins such as polytetrafluoroethylene and various thermoplastic films. The coating is intended to insulate the elastomeric stopper base from the content of the container in order to prevent contact and possible chemical reactions therebetween.

The prior art has provided various constructions and configurations to meet the requirements of stopper systems for use in the chemical/pharmaceutical industry. See, for example U.S. Pat. Nos. 2,665,024; 2,848,130; 3,088,615; 3,313,439; 3,974,930; 4,133,441; 4,227,617 and 4,441,621.

One of the major concerns in all products, and especially pharmaceutical parenteral products, is the generation of particulate foreign matter which may contaminate such products. In order to eliminate macroscopic and microscopic particulates, elaborate measures have been taken to remove them, such as filtration of the product and special washing and drying of the stopper system components. These steps help assure that the products meet the requirements and guidelines of the pharmaceutical industry, such as compendia guidelines, when the products reach the point of use. However, at the point of use, such as in the case of a parenteral product, new particulate matter is frequently generated by the practitioner when the stopper is penetrated by an infusion spike. During such penetration a combination of elastic and plastic deformation of the stopper target are increases the stopper contact surface with the infusion spike as it is pressed into the stopper. Typically, untreated elastomeric stoppers offer a high degree of resistance against the exterior surface of the spike as the spike is being pushed into the penetration area. Most frequently, when stopper fragments are generated, they are the result of the elastomeric portion of the stopper being abraded off the upper surface of the stopper as it conforms to the shape of the penetrating spike. The fragments are then transported into the interior of the vial as the spike rolls and drags the fragments during penetration.

In addition to the problem of particulate matter produced and carried into the vial during the spiking procedure, there are two other problems: spike blow-out caused by residual elastic tension of the stopper against the spike which urges the spike outward; and leakage around the spike with or without the occurrence of blow-out.

During spike penetration of the elastomeric stopper the target membrane at the penetration site is elastically distorted and ruptured creating a seal that is not radially uniform between the spike and the ruptured membrane. This radial non-uniformity is an inherent characteristic of the target membrane area, which is first stretched and then is torn by the spike. The tear so produced develops axially rather than radially and the tear surface is jagged, uneven and does not provide for a good seal between the spike and the membrane. As a result, spike retention failure and leakage around the spike occurs. Such failures are especially significant when the container is pressurized.

The most common solution to these problems has been the application of silicone lubricant to the stopper and/or the spike to reduce the frictional drag between the stopper and the spike. While silicone does reduce particle generation from the spiking procedure, it also increases the risk of product contamination from its own composition. In addition, silicone lubrication of the stopper renders the inserted spike slippery and causes spike blow-out.

Another approach proposed in the prior art to reduce the tendency of the spike to generate particulate matter during penetration is to coat the elastomeric core of the stopper with a thermoplastic film on the fluid contacting side thereof. We have found, however, that the use of such construction is less than satisfactory to solve the problem. Furthermore, such construction does not provide for improved spike retention and reduced leakage tendency around the spike.

It is an object of the present invention to reduce the potential for leaking, reduce or eliminate the level of fragmentation and increase the spike insertion and especially the spike withdrawal force.

Accordingly, the present invention provides in a stopper a second seal upon insertion of the infusion spike into the stopper. This second seal is a dynamic seal created between an annular rim or protuberance of the stopper and the cylindrical shaft of the spike as the spike is being inserted into the stopper. The annular rim of the stopper is distorted with a slight elastic bend toward the center of the bottle creating a radially uniform seal between it and the spike. The frictional drag between the spike and the rim coupled with the natural tendency of the elastomer to return to is original position enhances the ability of the stopper to retain the infusion spike and produce a second seal in the stopper. In the event that the bottle should be pressurized, an additional force would be imparted on the second seal thereby enhancing the contact of the stopper with the infusion spike.

SUMMARY OF THE INVENTION

The present invention provides an elastomeric stopper for a fluid-containing bottle to hermetically seal the content therein and to provide access thereto by the insertion of an infusion spike through the stopper having a head portion and a skirt portion extending from said head portion, said head portion comprising:

(a) a flange extending laterally outwardly from said skirt portion and is designed to cover a transverse end surface of a bottle neck; and (b) a target area at the center of the head portion designed to be pierced by an infusion device or spike which, after rupturing the target area, is inserted through the space defined by said skirt portion;

said skirt portion comprising:

(c) a cylindrical surface spaced downward from said target area of the head portion adapted to guide and grip said spike upon its insertion through said target area; and (d) an annular protuberance located between said target area and cylindrical area to form a seal with said spike.

During spike penetration the target area is ruptured and elastically distorted creating a seal that is not radially uniform. This non-uniformity permit leakage between the ruptured elastomer and the spike. The present invention provides a second seal or dynamic seal between the annular protuberance and the spike: the protuberance is contacted by the spike and distorted with a slight elastic bend downward toward the center of the bottle creating a radially uniform seal. Under normal pressure conditions the frictional drag between the spike and the annular protuberance produces an additional seal heretofore unknown in the prior art. When the bottle is pressurized, the internal pressure imparts an additional force on the annular protuberance thereby enhancing the contact between the protuberance and spike.

The second or dynamic seal insures against leakage and blow-out as well as reduces the risk of particulate matter introduction into the bottle upon insertion of the spike through the stopper.

BRIEF DESCRIPTION OF THE DRAWINGS

With reference to the annexed drawings, illustrating the invention.

DESCRIPTION OF THE PREFERRED EMBODIMENT

Figure 1:
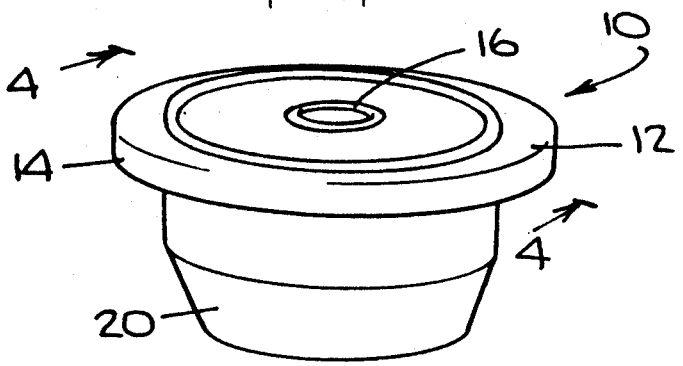
FIG. 1 is a perspective view of the stopper of the present invention.
Figure 2:
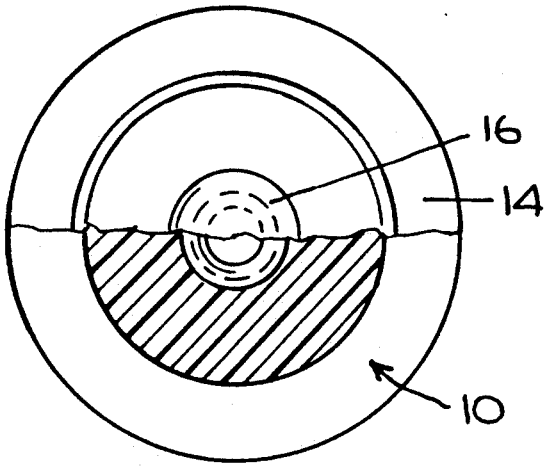
FIG. 2 is a sectional top view thereof.
Figure 3:
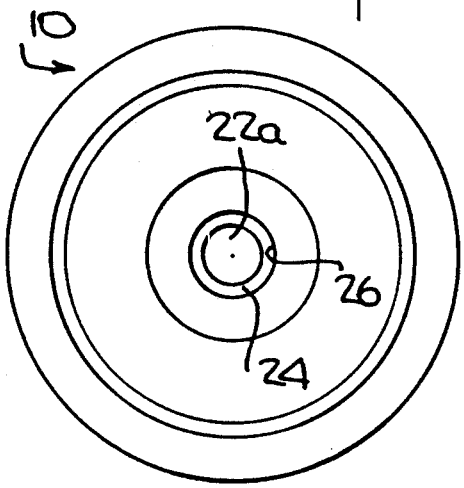
FIG. 3 is a bottom plan view thereof.
Figure 4:
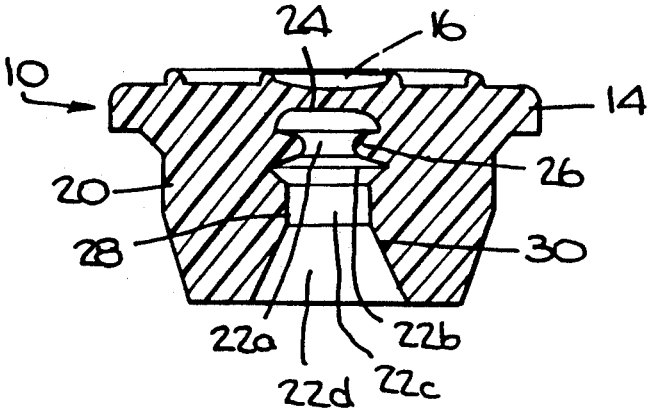
FIG. 4 is a sectional view of the stopper taken along the line 4—4 of FIG. 1.
Figure 5:
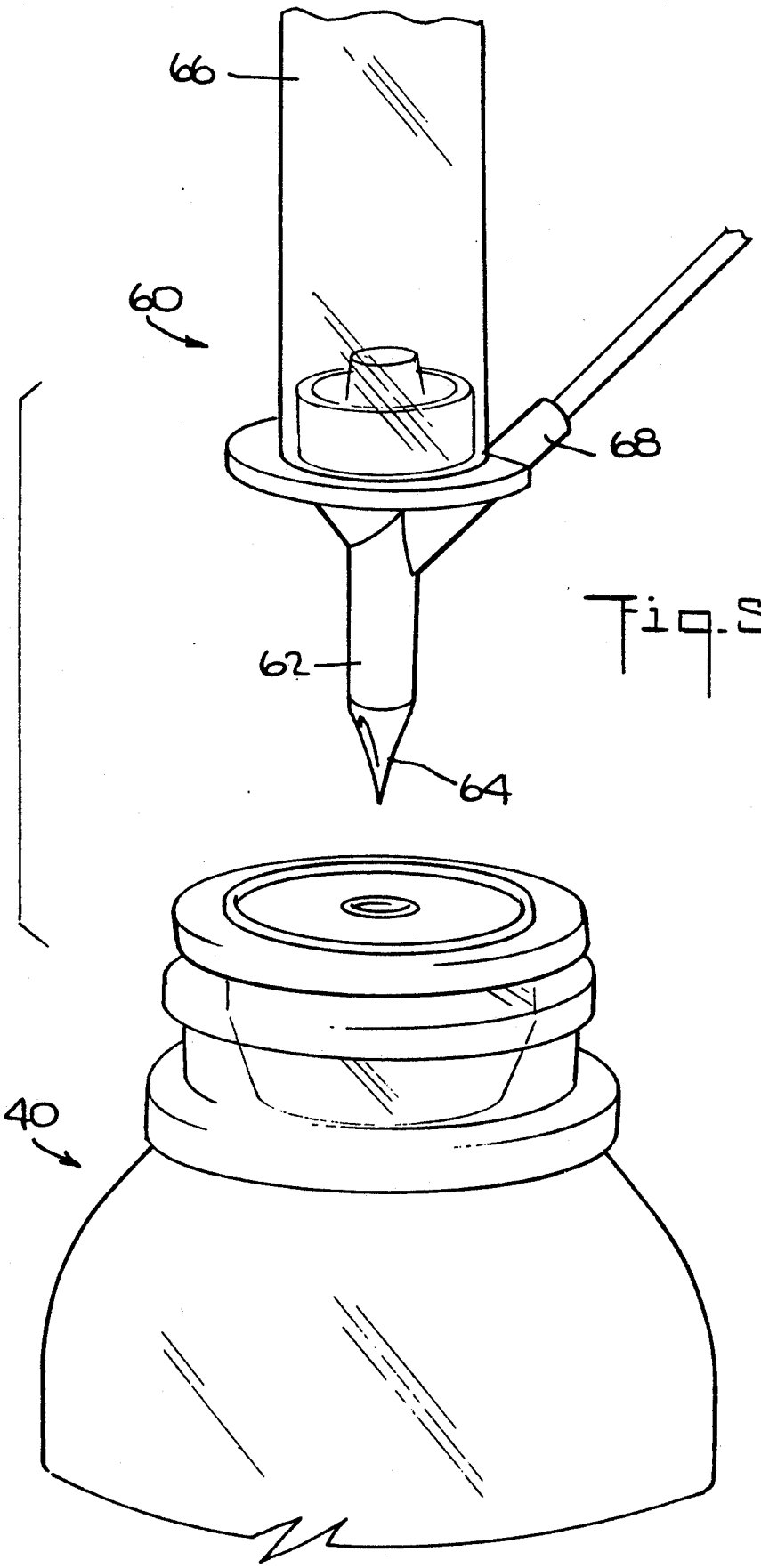
FIG. 5 is a perspective view of a bottle having inserted therein the stopper of the present invention and an infusion spike positioned ready for insertion into the stopper.

Referring to FIGS. 1 and 5 through 8, the elastomeric stopper 10 of the present invention is designed to hermetically seal a bottle 40 or like containers of pharmaceutical fluids, especially parenteral solutions, which at times may be sealed by vacuum or under pressure. The bottle 40 is of glass or rigid polymer material well known in the pharmaceutical industry. It comprises a neck 42 having an interior surface 44, interior radial ring 46 and transverse end surface 48. The two latter parts form the mouth of bottle 40. The neck 42 further comprises an exterior surface which, adjacent to the transverse end surface 48, evolves into an exterior radial ring 50. Said exterior radial ring is adapted to facilitate the holding of a metal cap (not shown) when the cap is crimped onto the bottle. The bottle is of standard size customarily used for liquids in the pharmaceutical industry and it may be from 5 ml to 1000 ml or more.

Referring to FIGS. 1 through 4 and 6 through 7, stopper 10 of the present invention comprises a head 12 and integral therewith a skirt 20. Head 12 comprises: a flange 14 extending laterally outwardly from skirt 20 and is adapted to cover transverse end surface 48 of bottle neck 42; and target area 16 which is to receive an infusion device or spike 60. Skirt 20 contains a generally cylindrical recess or opening indicated by the numerals *22a*, *22b*, *22c* and *22d*. Recess *22a* is defined by: transverse web 24 at the upper end which corresponds to target area 16 when viewed from the bottom open end of the skirt 20 toward head 12 direction. Spaced downward from said transverse web 24 and integral therewith, annular protuberance 26, laterally extending into said opening *22a*, is designed to form a dynamic seal or second seal when an infusion device or spike 60 (shown in FIG. 5) is inserted into stopper 10. Recess *22a* serves as a space into which the ruptured edges of the target area 16 will be pushed down into upon the target area 16 being pierced by infusion device 60.

Spaced downward from said annular protuberance 26 and integral therewith, a cylindrical wall surface 28 designed to tightly conform to the exterior surface wall 62 of the infusion device or spike 60 when the same is inserted into stopper 10 and it guides and grips the same. Opening *22c* allows shaft 62 of spike 60 to be inserted therethrough. Recess *22b* is defined by annular protuberances 26 and top edge of cylindrical surface 28. Recess *22b* serves as a space which allows annular protuberance 26 to extend into and bend downward toward the center of the bottle when shaft 62 of spike 60 engages said protuberance and forms the dynamic seal therewith.

Spaced downward from cylindrical wall surface or cylindrical surface 28 and integral therewith, conical surface 30 defines opening *22d*. Opening *22d* allows skirt 20 of stopper 10 to flex inward when skirt 20 is being inserted into bottle 40.

Figure 6:
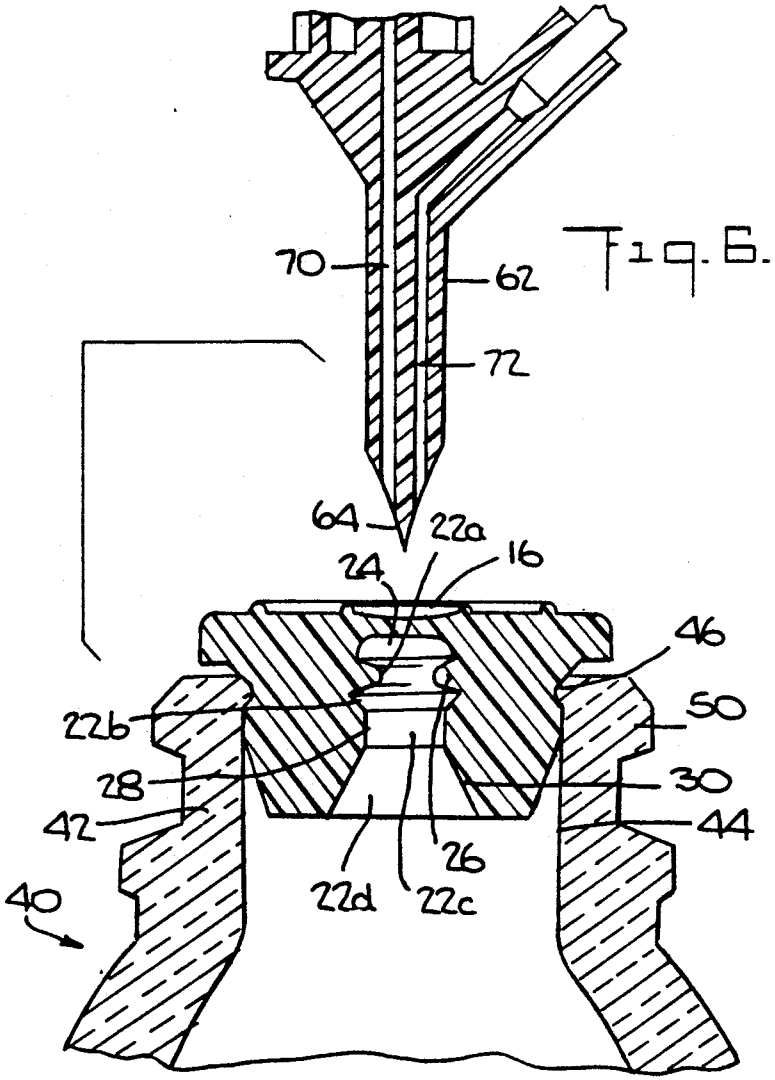
FIG. 6 is a sectional view of the bottle, stopper and infusion spike shown in FIG. 5.

Infusion device or spike 60 is well known in the art and may be of two designs, with or without a drip chamber. The device comprises: a cylindrical shaft 62 terminating in a sharp tip 64; and an upper body of two parts 66 and 68, both integral with said shaft 62. As shown in FIG. 6, shaft 62 and upper bodies 66 and 68 contain channels 70 and 72. When infusion device 60 is inserted into a bottle containing a pharmaceutical fluid, channel 70 serves for the withdrawal of said fluid, while channel 72 serves as a means through which air may be introduced into the bottle.

In use, the bottle 40 is sterilized and is filled with a pharmaceutical fluid, such as a parenteral solution. Stopper 10 is inserted hermetically sealing the content of the bottle. Stopper 10 is then crimped onto bottle 40 with an aluminum or like closure cap customarily used on such pharmaceutical containers. Upon requirement to withdraw the pharmaceutical fluid, infusion device or spike 60 is inserted into bottle 40 through stopper 10. The sharp tip 64 is aimed at the center of the stopper, defined as target area 16, pierced through transverse web 24 and continued to be inserted until shaft 62 of spike 60 engages cylindrical surface 28. As the spike 60 is inserted into stopper 10, the thin membrane, defined as transverse web 24, is ruptured, then a dynamic seal (second seal) is formed between shaft 62 of spike 60 and annular protuberance 26. Zonal contribution to the control of leaking and spike retention will now be explained with reference to FIG. 8 which displays the position of the target area 16 (transverse web 24), the dynamic seal (or second seal formed by shaft 62 and annular protuberance 26), and the cylindrical surface 28 engaging shaft 62 of spike 60. The forces involved in retaining the spike in the stopper are zone specific.

Figure 7:
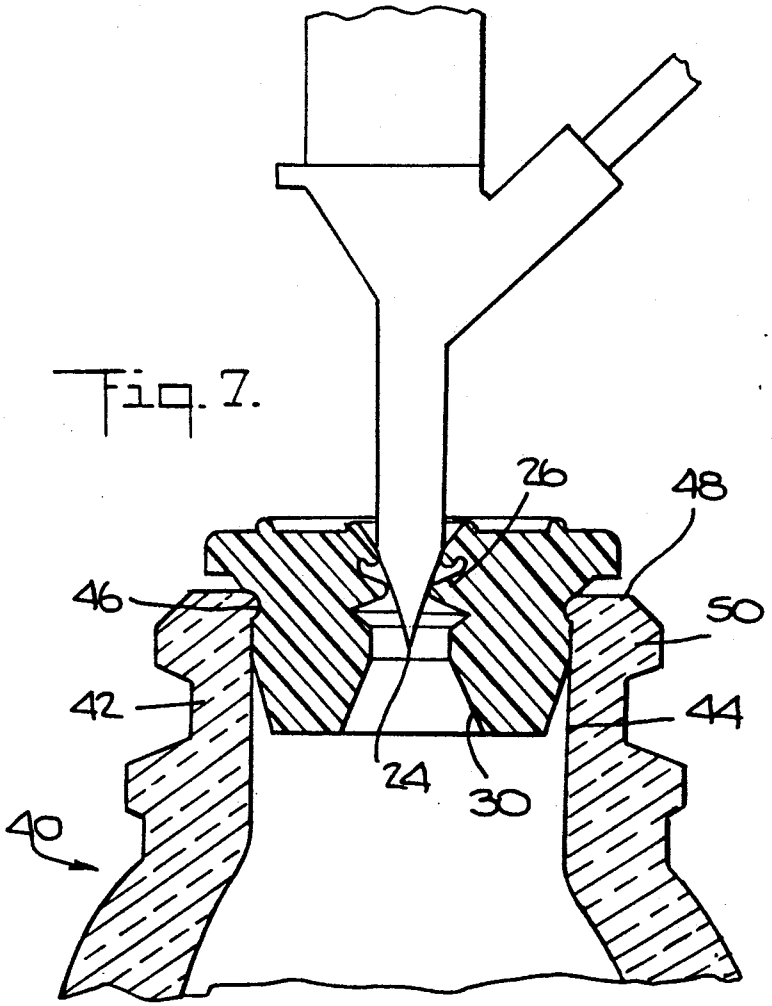
FIG. 7 is a sectional view, similar to FIG. 6, with the infusion spike partially inserted in the stopper.

Target area 16 retains the spike in position primarily through the compression created by the displaced elastomeric material. The viscoelastic properties of the elastomer create a force in the distorted elastomer which urges the elastomer to return to its normal, or resting position. These properties are referred to in the art as elastic memory. The interference of shaft 62 of spike 60 prohibits the return of the elastomer to its original position and creates a compression force that grips shaft 62 and prevents it from falling out of stopper 10 when bottle 40 is inverted for administration of its content. FIG. 7 illustrates the piercing of transverse web 24 by sharp tip 64 and shaft 62 of spike 60. It can be seen that the membrane is being tugged towards the center of bottle 40. This longitudinal strain of the elastomer reduces the compression loading of transverse web 24 at the location of the spike.

The dynamics of spike withdrawal can occur in two ways: first, the surface of shaft 62 of spike 60 can slip from transverse web 24. The configuration of the compressed, elongated transverse web 24 will not change should shaft 62 of spike 60 spike slip from the surface of transverse web 24 until shaft 62 is clear of stopper 10. Once shaft 62 of spike 60 is out of stopper 10, transverse web 24 returns to its original position. The dynamics of the second way of spike withdrawal concerns non-slipping, i.e. the surface of transverse web 24 and shaft 62 of spike 60 remain stuck together and follow each other as the spike is being removed. This requires transverse web 24 to invert as spike 60 is withdrawn. Inversion of the torn transverse web 24 will cause the compression force to increase. As shaft 62 pulls the torn transverse web 24 to its normal position the compression force is at its maximum. As shaft 62 is continued to be pulled out, the torn jagged edges of transverse web 24 are being pulled upward and transverse web 24 actually pushes the spike upward, away from the center of the bottle. When the upward longitudinal force equals the radial compression force, the spike will stop moving and additional force must be applied to withdraw the spike. This force must overcome the surface friction and the stretching of the elastomer to have the spike released from the stopper.

Prior art stoppers having a membrane just described often leak due to a misalignment of the shaft as it is pushed into cylindrical surface 28 causing excessive axial loading on the seal made by transverse web 24 and cylindrical surface 28. Because the seal formed by the transverse web 24 and shaft 62 is not radially uniform, a leak caused by a misalignment depends on the position of the spike. If the misalignment is in the same axis as the tear, a leak is less likely to occur than if the misalignment is perpendicular to the axis of the tear.

The contribution of cylindrical surface 28 to good sealing properties in a stopper is rather difficult to evaluate since no two piercings are exactly alike. Cylindrical surface 28 is cylindrical and is displaced and compressed by shaft 62 which is also cylindrical. Because of their similar shapes there is no seal concentration point. Without a seal concentration point the sealing surfaces must be parallel within the limits of elasticity of the stopper or a path allowing the fluid to leak will exist. If an axial load is placed on shaft 62, it will not remain parallel to cylindrical surface 28 and a leak can occur. It is also to be understood that cylindrical surface 28 does not contribute a dynamic force to prevent leakage at the spike; cylindrical surface 28 only serves to guide the spike as the spike is being inserted into the bottle. The force cylindrical surface 28 exerts on spike 60 is diameter dependent. The force is determined by the displacement of the spike as it is engaged by the cylindrical surface. If the pressure of the bottle is increased, for example, by injecting air into the bottle with a syringe, the force applied to the cylindrical surface by such pressure will work to enlarge the opening which can cause a leak. The same pressure increases which works on the cylindrical surface will also affect the transverse web 24 which on piercing has been stretched downward towards the center of the bottle. The internal pressure will work on the transverse web 24 to return it to its original position.

Similarly to the seal contribution of cylindrical surface 28, the retention contribution of the same is diameter dependent. The force required to remove the spike from cylindrical surface 28 is directly proportional to the diameter of the spike as well as the diameter of the cylinder defined by cylindrical surface 28. Testing has demonstrated that cylindrical surface 28 contributes the most force to the retention of the spike. However, due to the distance from the transverse web 24 of the stopper to cylindrical surface 28, the spike will pull out first from the cylindrical surface 28 on its way out of the stopper. Once tip 64 of spike 60 engages the lower edge of cylindrical surface 28, the applied force to tip 64 pushes the spike further out of the stopper. As with the sealing contribution of cylindrical surface 28, the retention contribution of the cylindrical surface does not contribute a dynamic force to grip the spike.

From the foregoing it is apparent that neither the transverse web 24, nor cylindrical surface 28 insures against the occurrence of leakage or expulsion of the spike from the stopper, especially when the content of the bottle is under pressure.

Figure 8:
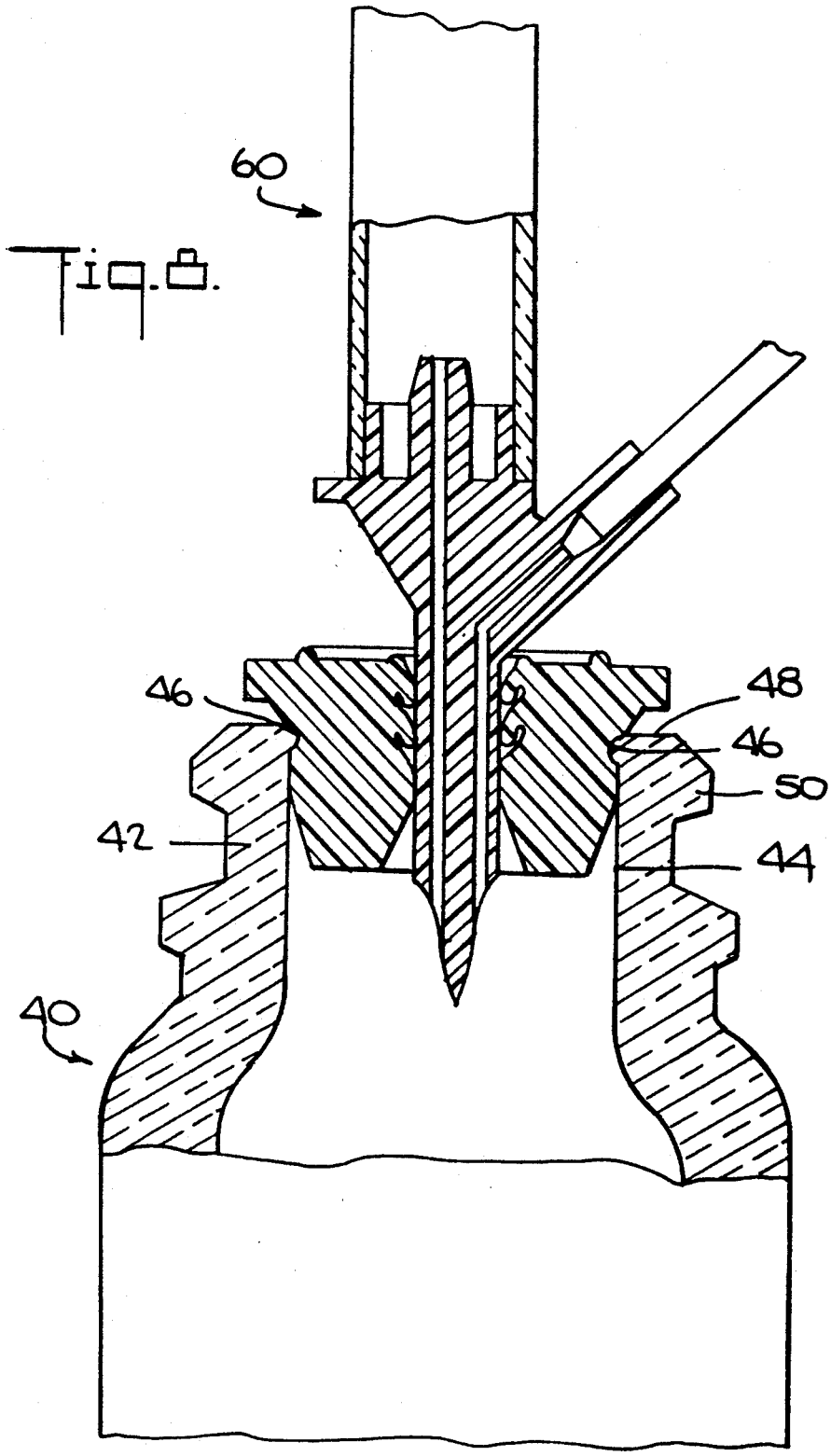
FIG. 8 is a sectional view, similar to FIGS. 6 and 7, with infusion spike fully engaged in the stopper.

The present invention alleviates these inadequacies by providing a dynamic seal or second seal which is produced by annular protuberance 26 and shaft 62 of infusion spike 60. The annular protuberance 26 is located between transverse web 24 and cylindrical surface 28. Referring to FIGS. 7 and 8, as shaft 62 of spike 60 is inserted into stopper 10 annular protuberance 26 is elongated both radially and longitudinally. Since the elastomeric material of annular protuberance tries to return to its relaxed position, two forces are created. One force grips shaft 62 by constricting radially, the other by pulling the shaft towards the original relaxed position. These forces are not equal. The primary force is determined by the percentage of the elongation in the elastomer. If, by the size of its diameter, the shaft 62 forces annular protuberance 26 to elongate radially more than the insertion caused longitudinal elongation, the constriction force will be greater than the rebounding elongation force. Once shaft 62 is engaged by annular protuberance 26, the constricting force will hold the spike in place.

The dynamic seal becomes the primary seal of the spike, which heretofore has not been perceived or suggested by the prior art. As such, a uniform, predictable force is established between annular protuberance 26 and shaft 62 of spike 60 insuring against leakage of content from bottle 40.

Another design advantage of the stopper according to the present invention is the stopper's ability to increase the spike retention force which is proportional to the internal pressure of the bottle. Pressure exerted at any point upon a confined liquid is transmitted undiminished in all directions, according to Pascal's law. As indicated earlier, the annular protuberance 26 conforms to the shaft 62 of spike 60 as the spike is being inserted into stopper 10. The orientation of annular protuberance 26 changes during insertion from being perpendicular to spike 60 to being close to parallel to it. When the pressure in the bottle increases, the pressure transmitted to all surfaces of the stopper will increase uniformly. However, the area of the annular protuberance 26 which is close to parallel to the shaft 62 will apply the most force to the shaft, and the area of the annular protuberance 26 which is essentially perpendicular to shaft 62 will have the least effect on the sealing of the shaft. The seal so produced is radially uniform.

In order for the dynamic seal to function in accordance with the present invention, it will be appreciated by those skilled in the art that certain relative proportions between the diameter of shaft 62 and the diameter of the space defined by annular protuberance 26 must be maintained. As shown in FIGS. 7 and 8, the diameter of the space defined by annular protuberance 26 must be somewhat smaller than the diameter of shaft 62 in order to create a tight seal between them. Further, the diameter of the cylinder defined by cylindrical surface 28 should also be somewhat smaller than the diameter of shaft 62, again, for the purpose of maintaining good guidance when spike 60 is being inserted into stopper 10. In commerce, of course, various size stoppers, bottles and spikes would be provided with corresponding requirements as to their proportions as they are used together in a unit.

The elastomeric material of the stopper of the present invention should be a fluid impervious, resilient, and inert material without leachable additives therein in order to prevent any alteration of the product contained in the vial. It may be of a single component or a blend of components. Examples of materials include synthetic or natural rubber, such as butyl rubber, isoprene rubber, butadiene rubber, silicone rubber, halogenated rubber, ethylene propylene therpolymer and the like. Specific examples of a synthetic elastomeric rubber include the $CH_2CF_2—C_3F_6(C_3F_5H)$ and the $C_2F_4—C_2F_3OCF_3$ series of elastomers made by duPont under the trade names of VITON® and CARLEZ®; the fluoro-silicone rubbers, such as those made by Dow Corning under the name of SILASTIC®; and polyisobutylenes, such as VISTANEX MML-100 and MML-140; and halogenated butyl rubber, such as CHLOROBUTYL 1066, made by Exxon Chemical Company.

These or other suitable elastomers may be made into the desired stopper configuration by known methods. Such methods conventionally include the use of a curing agent, a stabilizer and a filler and comprise a primary and secondary curing step at elevated temperatures.

The stopper according to the present invention, in combination with a bottle and IV infusion spike, was tested for fragmentation, penetration and retention forces as well as elimination of leakage by test methods used in the pharmaceutical industry. Test results showed substantial improvements in all of these desirable properties as compared to properties possessed by similar devices used in the prior art.

The present invention has been described in connection with the preferred embodiments shown in the drawings, it is to be noted, however, that various changes and modifications are apparent to those skilled in the art.

What is claimed is:

1. An infusion closure for use with a parenteral liquid-containing vial to hermetically seal said vial and to provide access for infusion of the liquid to a patient, said vial having a neck terminating in a transverse end surface, said infusion closure comprising the combination of an elastomeric stopper and an infusion spike inserted into said stopper, said stopper having a disk-shaped head and an annular skirt integral with said disk-shaped head, said annular skirt projecting into said liquid-containing vial, said disk-shaped head having a flange extending laterally outward from said skirt covering said transverse end surface of said vial neck, a target area centrally located in said disk-shaped head through which said infusion spike is inserted into said vial forming a first seal with said infusion spike and having ruptured edges oriented toward said liquid, said skirt having a generally cylindrical opening defined by a transverse web on the top of said opening corresponding to said target area, an annular protuberance, spaced downward from said transverse web and integral therewith, laterally extending into said opening and being elongated longitudinally toward said liquid in said vial and forming a second seal with said infusion spike, an annular recess between said transverse web and said annular protuberance designed to serve as space to accommodate said ruptured edges formed by said infusion spike upon its insertion through said target area, a cylindrical wall surface, having a top edge, spaced downward from said annular protuberance and integral therewith, to guide and grip said infusion spike, an annular recess, between said annular protuberance and said top edge of said cylindrical wall surface, designed to serve as space into which said annular protuberance extends upon insertion of the infusion spike, said infusion spike having a cylindrical shaft having a tapered end terminating in a sharp tip, an upper body having two parts both integral with said cylindrical shaft, a first channel, extending from said tip upward through said shaft and through one part of said upper body, adapted to remove said liquid from said vial, and a second channel extending from said tip upward through said shaft and through the other part of said upper body to allow air to enter into said vial to equilibrate pressure within said vial when said liquid is being removed from said vial by infusion to a patient.

* * * * *